US005913359A

United States Patent [19]

Milligan et al.

[11] Patent Number: 5,913,359

[45] Date of Patent: Jun. 22, 1999

[54] BYPASS SEALS FOR ROTARY REGENERATIVE HEAT EXCHANGERS

[75] Inventors: Brenda L. Milligan, Wellsville; Clair F. Updyke, Andover, both of N.Y.

[73] Assignee: ABB Air Preheater, Inc., Wellsville, N.Y.

[21] Appl. No.: 09/179,045

[22] Filed: Oct. 26, 1998

[51] Int. Cl.[6] ..... F23L 15/02

[52] U.S. Cl. ..... 165/9; 165/10

[58] Field of Search ..... 165/9, 10, 8, 6, 165/4

[56] References Cited

U.S. PATENT DOCUMENTS

| | | | |
|---|---|---|---|
| 3,216,486 | 11/1965 | Hall et al. | 165/9 |
| 5,048,595 | 9/1991 | Harder | 165/10 |
| 5,119,885 | 6/1992 | Johnson | 165/10 |
| 5,540,274 | 7/1996 | Slocum et al. | 165/9 |
| 5,664,621 | 9/1997 | Brophy | 165/8 |
| 5,740,856 | 4/1998 | Ritter | 165/10 |

FOREIGN PATENT DOCUMENTS

| | | | |
|---|---|---|---|
| 2272507 | 5/1994 | United Kingdom | 165/9 |

*Primary Examiner*—Ira S. Lazarus
*Assistant Examiner*—Christopher Atkinson
*Attorney, Agent, or Firm*—Alix, Yale & Ristas, LLP

[57] ABSTRACT

A heating element basket assembly for a rotary regenerative air preheater has a picture-frame structure with the open areas on each side being covered by a flat plate attached to the inside of the frame. A sealing plate member is attached to the outside of each of the flat plates within framework. The sealing plate member has a portion bend and protruding outwardly from the periphery of the basket to form a flexible seal for engagement with the diaphragms and stay plates of the rotor.

3 Claims, 6 Drawing Sheets

BYPASS SEALS FOR ROTARY REGENERATIVE HEAT EXCHANGERS

BACKGROUND OF THE INVENTION

The present invention relates to means for reducing or eliminating the internal bypassing of gas streams around the heating elements in rotary regenerative heat exchangers and particularly relates to the internal bypassing of air and flue gas streams around the heating elements in an air preheater.

In a rotary regenerative air preheater, the rotor is divided up by diaphragm plates into pie-shaped sectors, which are in turn subdivided into rotor compartments by stay plates. Each rotor compartment is designed to accommodate one or more assemblies of heating elements comprising basket-like containers with heat transfer surfaces therein. Because of fabrication tolerances and/or the distortion of the rotor structure associated with extended operation under varying thermal conditions, it is usually necessary to design the heating elements to allow a clearance around each basket so as to avoid interference at installation.

When fabrication tolerances, rotor distortion and/or design clearances result in excessive gaps ("bypass gaps") between the sides and ends of the baskets and the corresponding walls of the rotor compartment or an adjacent basket, a portion of the air and gas streams will flow through the gaps thereby bypassing the heat transfer surfaces and thereby resulting in a loss in heat transfer efficiency.

SUMMARY OF THE INVENTION

The present invention provides a unique means to reduce or eliminate the bypass of air and flue gas around the heat transfer baskets in the compartments of rotary regenerative heat exchangers. The invention relates to picture frame style baskets with frame members along all the edges of the basket and involves the attachment of liner plates on the insides of the frame members on the sides and ends much as is done with so-called hybrid baskets (picture frame baskets with plates closing off the sides and ends). Attached to the outside of the liner plates are sealing plates which have a portion deflected outwardly to form flexible sealing strips which seal against the compartment walls.

DESCRIPTION OF THE PREFERRED EMBODIMENTS

The present invention relates to the heating elements for rotary regenerative air preheaters in which the heating elements are loaded into compartments in the rotor. As well known in the art, the compartments are formed by radially extending diaphragms forming pie-shaped sectors and by a series of tangentially extending stay plates dividing each sector into multiple compartments. As also known in the art, the heating elements must be slightly undersized in order to facilitate loading into and unloading out of the compartments. This means that there are clearances or gaps between the sides of the heating elements and the diaphragm plates and between the inboard and outboard ends of the heating elements and the stay plates. As previously indicated, these gaps result in the bypass of air and flue gas around the heat transfer surface in the heating elements.

Figure 1:
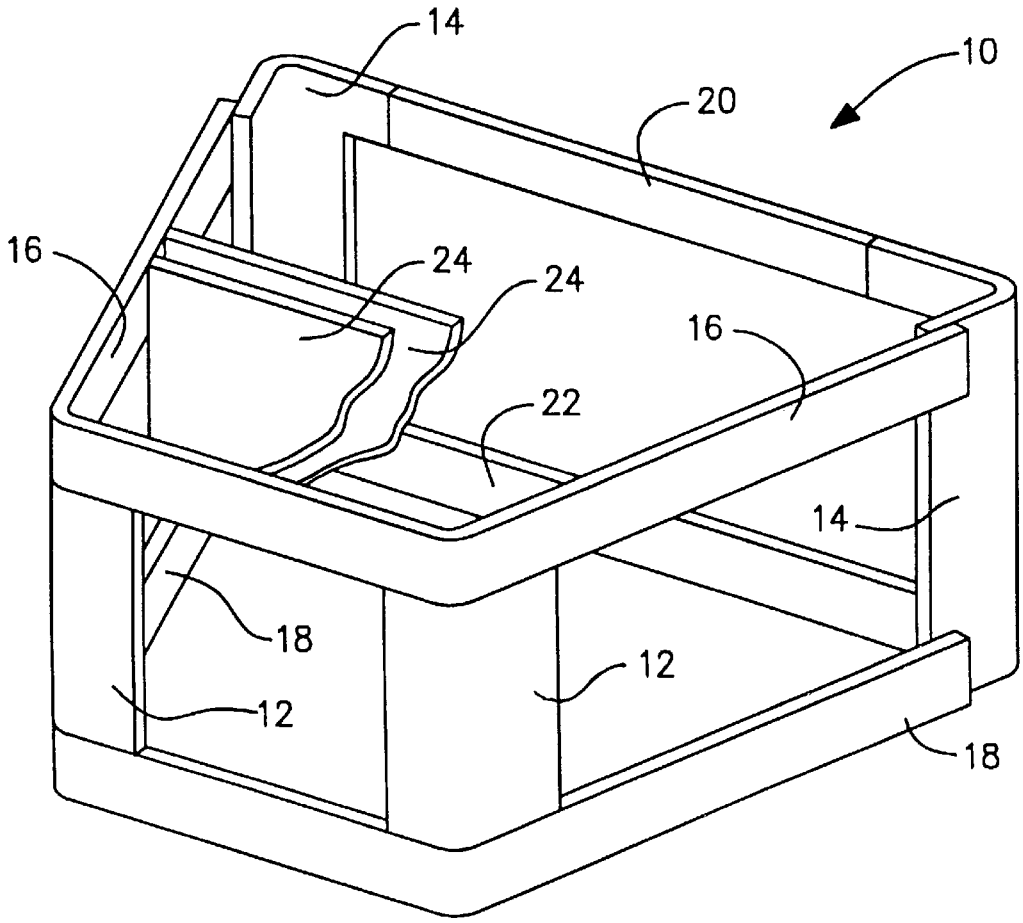
Fig. 1 PRIOR ART
FIG. 1 is a perspective view of a typical prior art rotary regenerative air preheater basket of the picture frame type.

FIG. 1 of the drawing shows a typical frame work 10 for a heating element basket of the picture frame type. The frame work 10 includes the two vertical inboard end corner pieces 12 and the two vertical outboard end corner pieces 14. The top band 16 and the bottom band 18 each extend around three sides and join the four corner pieces. The outboard top band 20 and bottom band 22 join the two corner pieces 14. The basket 10 contains the heat transfer surface in the form of a large number of closely spaced plates 24. Only two such plates are shown in this FIG. 1. The heating element is assembled by joining the two corner pieces 12 and the top and bottom bands 16 and 18. The heat transfer surface plates 24 are then loaded from the outer end. The cover comprising the two outer corner pieces 14 assembled with the top and bottom bands 20 and 22 is then attached. Not shown in this FIG. 1 or in the other figures for reasons of clarity are the conventional support bars for the heat transfer surface plates which extend radially from the inner end to the outer end across both the top and bottom of the element. When these heating elements are loaded into the compartments of the air preheater rotor, there are gaps between the periphery of the heating elements and the walls of the compartments as explained earlier and as will be shown later.

Figure 2:
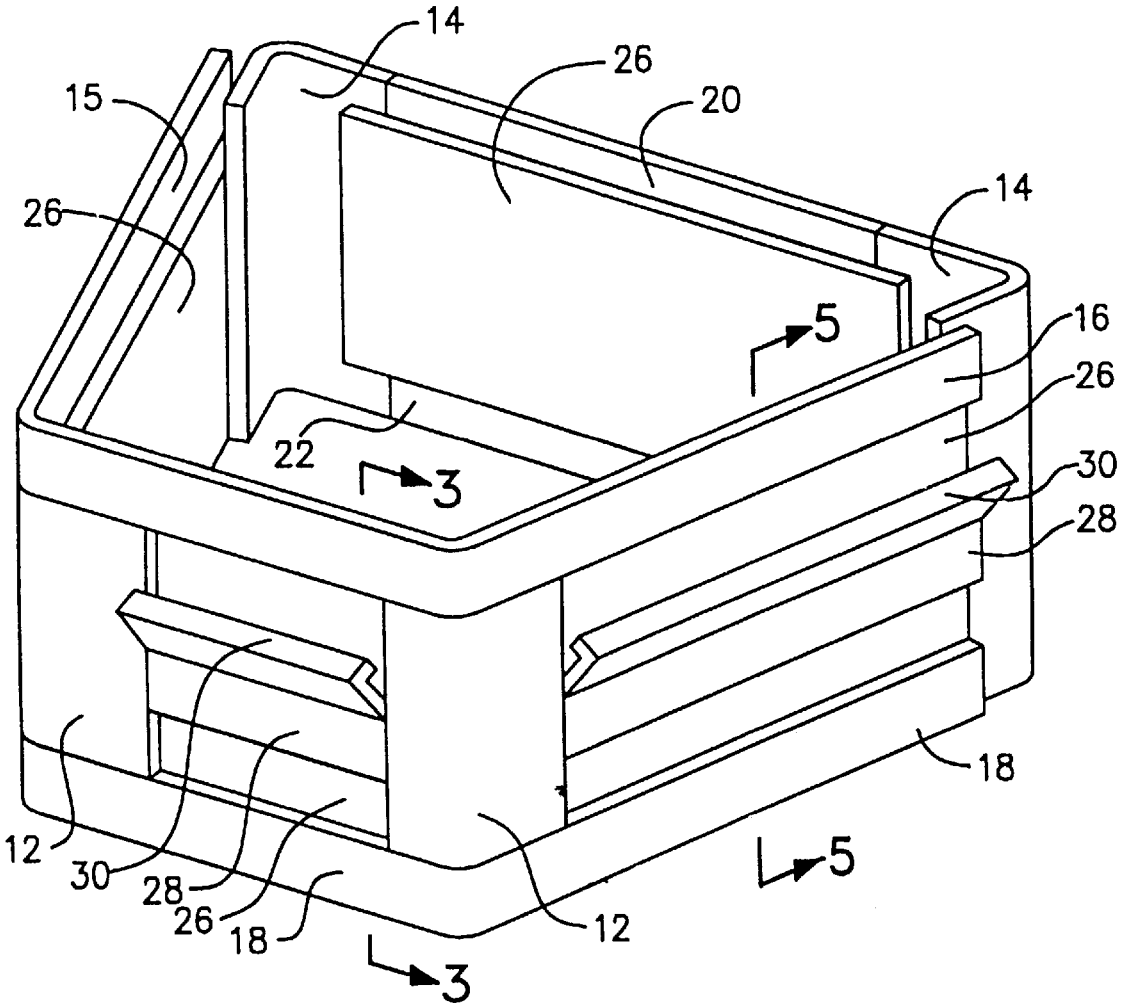
FIG. 2 is a similar perspective view of a picture frame type basket modified to incorporate the present invention.

FIG. 2 is a perspective view of the same type of basket as illustrated in FIG. 1 but which incorporates the present invention. Located on all four sides of the basket are flat liner plates 26. These flat liner plates 26 are attached to the insides of the frame, such as by spot welding, such that they completely cover the picture frame opening in each side. This is much the same as what is sometimes referred to as a hybrid basket structure with the sides closed off as in a full wrap basket structure.

Figure 3:
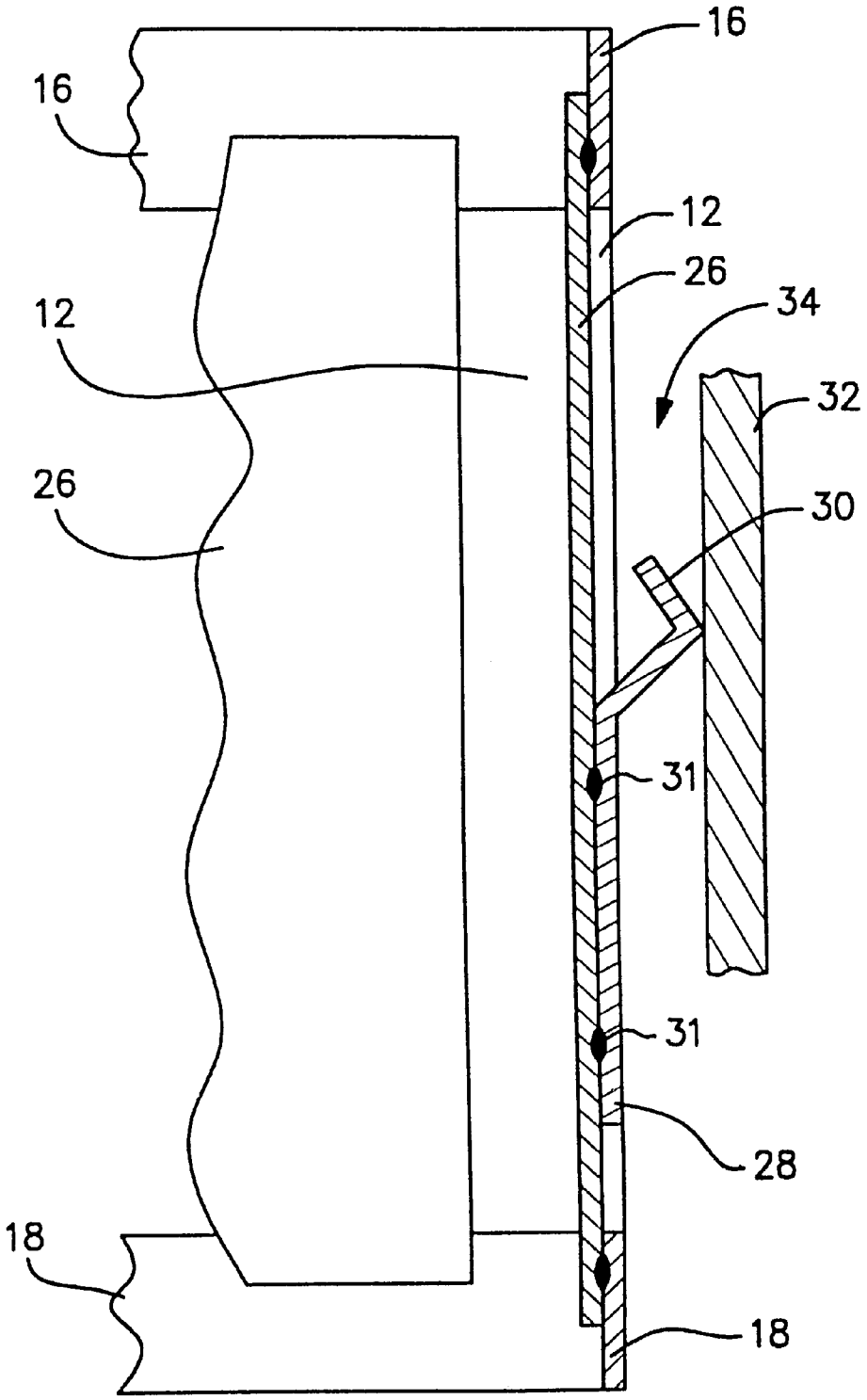
FIG. 3 is a vertical cross-section view of the inner end of the basket of FIG. 2 taken along line 3—3.
Figure 4:
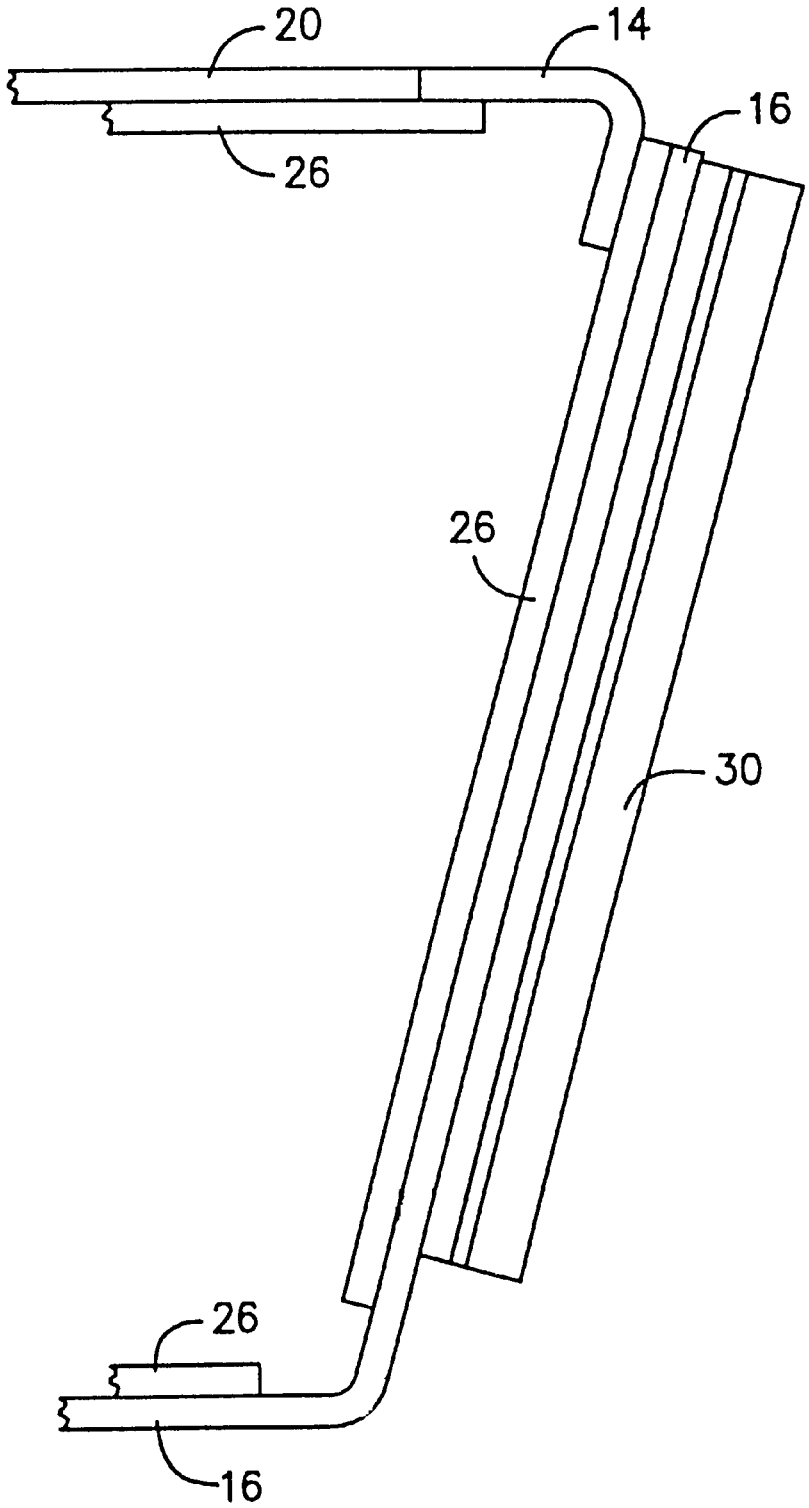
FIG. 4 is a top view of a portion of the basket of FIG. 2.
Figure 5:
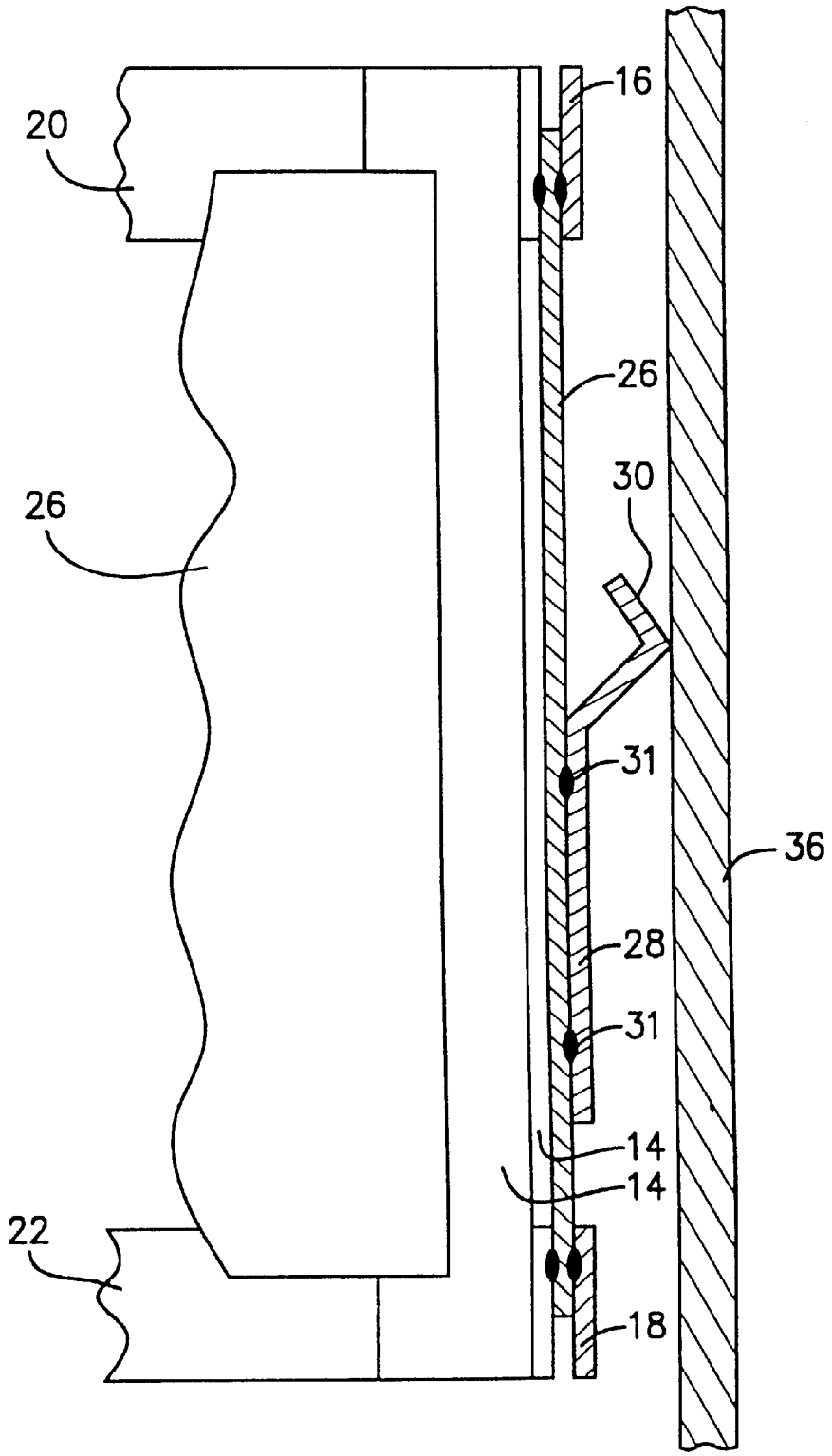
FIG. 5 is a vertical cross-section view of one of the sides of the basket of FIG. 2 taken along line 5—5.

Mounted to the outside of the flat liner plates 26 within the picture frame opening is a sealing plate 28 which has a portion deflected or bent outwardly to form a flexible sealing strip 30. FIG. 3 shows a cross-section of the inner end of the basket taken along line 3—3 to further illustrate the structure. As shown at 31, the sealing plate 28 is spot welded to the flat liner plate 26. This FIG. 3 also shows a stay plate 32 of the rotor structure and illustrates how the flexible sealing strip 30 seals against the stay plate and closes off the gap 34 between the basket and the stay plate. As a further detailed illustration, FIG. 4 shows a to view of a portion of the basket of FIG. 2. To illustrate the details of the outer corners, FIG. 5 is a cross-section taken along line 5—5 of FIG. 2. As can be seen, the cover comprising the outer corners 14 and bands 20 and 22 are now installed on the inside of the flat liner plate 26. Also illustrated is a portion of a radially extending diaphragm plate 36 engaging the sealing strip 30.

Figure 6:
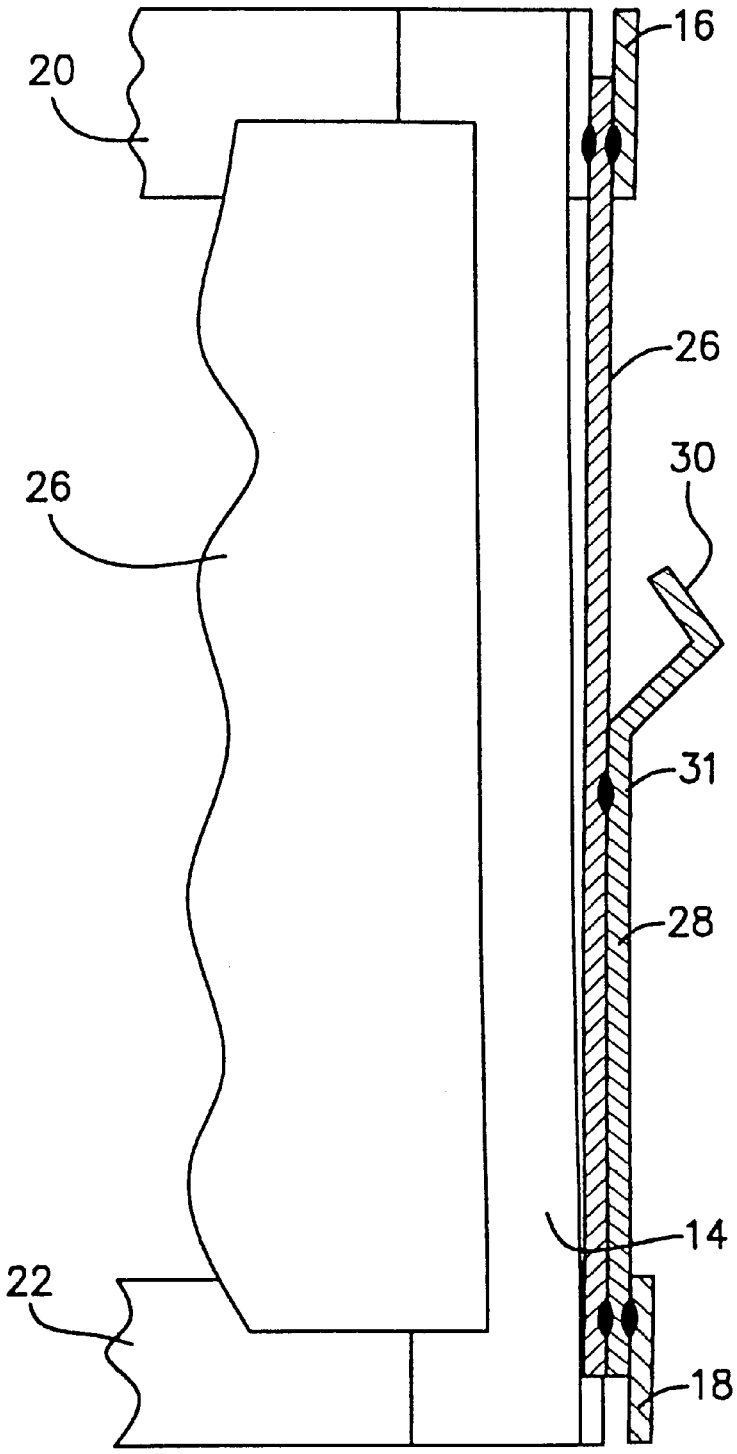
FIG. 6 is a vertical cross-section view similar to FIG. 5 but illustrating a modification.

FIG. 6 shows an alternate arrangement for mounting the sealing plates 28 on the sides of the basket. In this embodiment, the sealing plate extends down further below the picture frame opening such that the bottom end is sandwiched between the flat plate 26 and the bottom band 18. This provides added assurances that the sealing plates will remain in position.

We claim:

1. A heating element basket assembly for a rotary regenerative air preheater comprising:

a. a basket framework including two inner corner members and two outer corner members and top and bottom bands each extending around said assembly and joining said corner members together and defining a basket periphery and thereby forming open center portions on each face of said assembly;

b. a flat plate attached to the inside of said top and bottom bands and said corner members on each face of said assembly thereby covering said open center portions; and c. a sealing plate member attached to the outside of each of said flat plate members, said sealing plate members each having a flexible sealing strip extending parallel to the top and bottom bands and protruding outwardly from said basket periphery through said open center portion.

2. A heating element basket assembly as recited in claim 1 wherein said sealing plate members are welded to said flat plates.

3. A heating element basket assembly as recited in claim 1 wherein said sealing plate members extend down between said bottom band and said flat plate.

* * * * *